US006666728B2

(12) United States Patent
Tachi et al.

(10) Patent No.: US 6,666,728 B2
(45) Date of Patent: Dec. 23, 2003

(54) DIVIDED CONNECTOR AND A CONNECTION METHOD OF A DIVIDED CONNECTOR WITH A MATING CONNECTOR

(75) Inventors: Hideshi Tachi, Yokkaichi (JP); Yasushi Okayasu, Yokkaichi (JP); Kiyofumi Ichida, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/122,899

(22) Filed: Apr. 12, 2002

(65) Prior Publication Data

US 2002/0151202 A1 Oct. 17, 2002

(30) Foreign Application Priority Data

Apr. 17, 2001 (JP) ..... 2001-118725
Apr. 17, 2001 (JP) ..... 2001-118726

(51) Int. Cl.[7] ..... H01R 13/514
(52) U.S. Cl. ..... 439/701; 439/924.1; 439/248
(58) Field of Search ..... 439/701, 752, 439/924.1, 248, 247

(56) References Cited

U.S. PATENT DOCUMENTS 5,472,357 A * 12/1995 Yamanashi et al. ..... 439/701

* cited by examiner

*Primary Examiner*—Alexander Gilman
(74) *Attorney, Agent, or Firm*—Gerald E. Hespos; Anthony J. Casella

(57) ABSTRACT

A divided connector has an auxiliary connector (40A) displaceably mounted in a frame (20). The auxiliary connector (40A) is held in a semi-locked state by resilient locks (27) on the frame (20). When female and male connectors (F, M) are fitted to each other, the auxiliary connector (40A) is held by unlock preventing portions (52) of the mating connector that prevent the resilient locks (27) from being deformed in unlocking direction, and is connected with a mating side prior to the other auxiliary connector (40B). When this connection is completed, the resilient locks (27) are released and deform in unlocking direction to unlock the auxiliary connector (40A). The auxiliary connector (40B) is subsequently connected while displacing the auxiliary connector (40A) to a back side with respect to the connecting direction.

10 Claims, 20 Drawing Sheets

DIVIDED CONNECTOR AND A CONNECTION METHOD OF A DIVIDED CONNECTOR WITH A MATING CONNECTOR

BACKGROUND OF THE INVENTION

1. Field of the Invention

The invention relates to a divided connector and to a method of connecting a divided connector with a mating connector.

2. Description of the Related Art

Multi-contact connectors sometimes have a divided form, for example, to prevent an erroneous insertion of terminal fittings. The divided connector has auxiliary connector housings with terminal fittings mounted therein. The auxiliary connector housings are held in accommodating portions of a frame. The divided connector is connected to a mating connector so that the auxiliary connector housings connect with corresponding mating connector housings and the terminal fittings connect with mating terminal fittings. A large connection resistance is generated during the connection of a divided connector due to abrasion of the mating terminal fittings. Japanese Unexamined Utility Model Publication No. 5-55470 shows a connector that relies upon the cam action of a lever to reduce the connection force.

The connecting force has been increasing due to an ongoing tendency to increase the number of contacts of connectors. Thus, a means for further reducing the connecting force has been demanded.

The present invention was developed in view of the above problem and an object thereof is to provide a divided connector and a connection method with a reduced connecting force.

SUMMARY OF THE INVENTION

The invention is directed to a divided connector with a frame that has accommodating portions and auxiliary housings mounted in the accommodating portions. The auxiliary housings are connectable with mating housings in a mating connector. At least one auxiliary housing is displaceable in the frame along a connecting direction with the mating connector between temporary and final mount positions. The displaceable auxiliary housing contacts the mating housing while in the temporary mount position. The other auxiliary housing is connected subsequently with the mating housing while the displaceable auxiliary housing is displaced toward the final mount position. Accordingly, the contact timing of the displaceable auxiliary housing with the corresponding mating housing is different from that of the non-displaceable housing with its mating housing. A plurality of displaceable auxiliary housings may be provided and may have contact timings set differently. Thus, a first displaceable auxiliary housing may contact its mating connector housing at a different time than a second displaceable auxiliary housing. Accordingly, a peak value of a connecting force can be reduced by differing a connecting position of the displaceable auxiliary housing with the mating housing and that of the other housing(s).

A holding means may be provided between the displaceable auxiliary housing and the frame for holding the displaceable auxiliary housing at the temporary mount position when the mating connector is connected. The holding means may be freed when the connection of the displaceable auxiliary housing and the mating housing is complete. The holding means may comprise at least one resilient lock on an inner surface of the accommodating portion. The formation of the resilient lock on the inner surface of the accommodating portion of the frame enables the construction of the auxiliary housing to be simpler and smaller as compared to a case where a portion corresponding to the resilient lock is on the auxiliary connector housing.

The resilient lock preferably is a semi-locking mechanism that can be deformed resiliently in response to an external force of at least a specified magnitude exerted in the connecting direction for unlocking the displaceable auxiliary housing at the temporary mounting position.

The resilient lock preferably is prevented from undergoing a deformation in the unlocking direction by an unlock preventing portion in the mating connector while the displaceable auxiliary housing and the mating connector housing are being connected with each other. Thus, displacement of the displaceable auxiliary housing is prevented. However, the resilient lock is freed from the unlock preventing portion when the displaceable auxiliary housing and the mating housing are connected completely, thereby freeing the displaceable auxiliary housing. The divided connector has a simple construction because the resilient lock acts both as the semi-locking mechanism and as the holding means for the auxiliary housing.

Displaceable auxiliary housings preferably are arranged at opposite sides of the non-displaceable auxiliary housing. Accordingly, a connecting operation can be performed smoothly because the connection resistance is not skewed toward one side during the connection with the mating connector.

The holding means preferably comprises a resilient restricting piece at one or more of the displaceable auxiliary housings and a restriction receiving portion on the frame. The resilient restricting piece is deformable at an angle, and preferably a right angle, to the connecting direction. The resilient restricting piece is deformed by the mating connector to engage the restriction receiving portion while the displaceable auxiliary housing is being connected with the mating housing. Thus, displacement of the displaceable auxiliary housing is restricted. However, the resilient restricting piece is restored towards its original shape and is disengaged from the restriction receiving portion when the displaceable auxiliary housing is connected completely with the mating housing, thereby permitting displacement of the auxiliary housing.

The invention also is directed to a connection method for connecting a divided connector with a mating connector. The method comprises providing a plurality of auxiliary housings to be mounted individually in corresponding accommodating portions of the divided connector. The auxiliary housings each are connectable with one or more mating housings in the mating connector. At least one auxiliary housing is displaceably mounted into a frame along a connecting direction with the mating connector between a temporary mount position and a final mount position. The method further comprises bringing the displaceable auxiliary housing into contact with the mating housing while being positioned in the temporary mount position and subsequently connecting at least one other auxiliary housing with the mating connector housing while the displaceable auxiliary housing is displaced toward the final mount position.

Accordingly, the contact timing of the displaceable auxiliary housing with the corresponding mating housing is different from that of the non-displaceable housing(s) with the corresponding mating housing(s). Thus, a peak value of a connecting force can be reduced by differing a connecting position of the displaceable auxiliary housing with the mating connector housing and that of the other housings.

The connection method may further comprise the step of holding the displaceable auxiliary housing at the temporary mount position when the mating connector is being connected. The displaceable auxiliary housing is released after it has been connected completely the mating housings.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
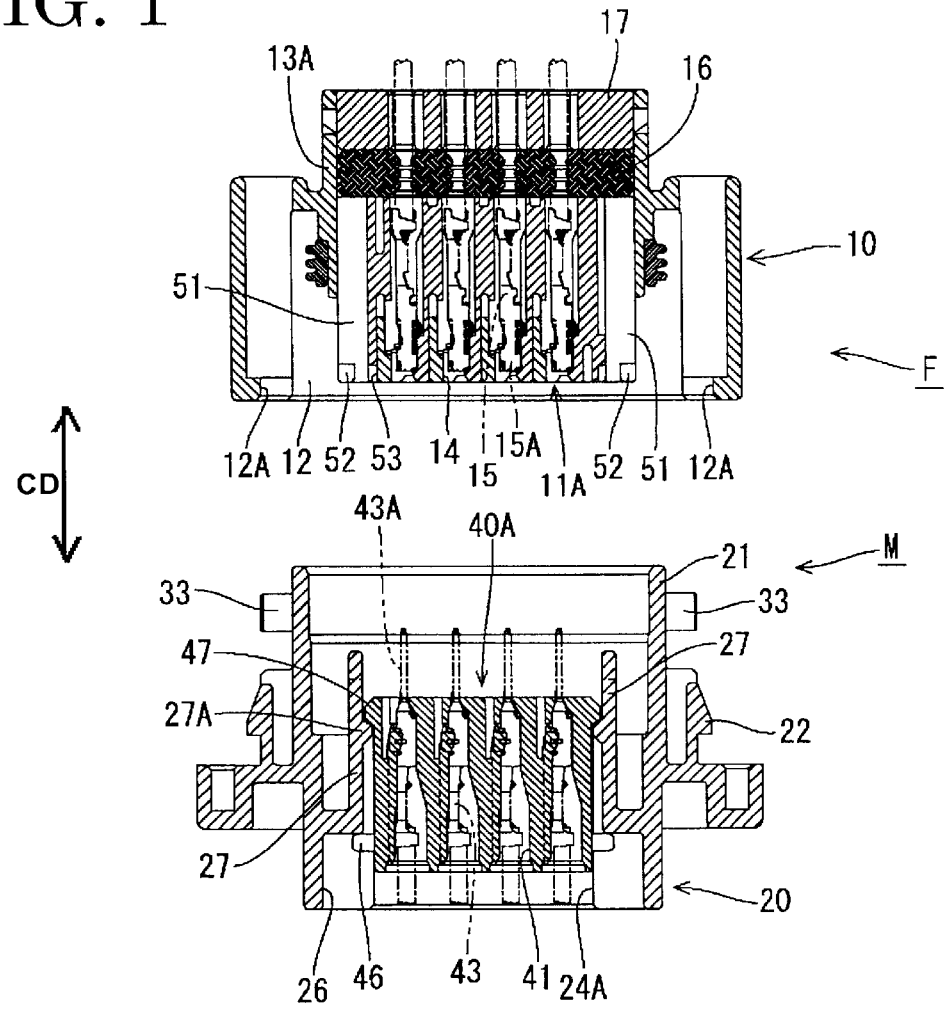
FIG. 1 is a front view in section of a divided connector according to one preferred embodiment of the invention before being connected (temporary mount position).
Figure 2:
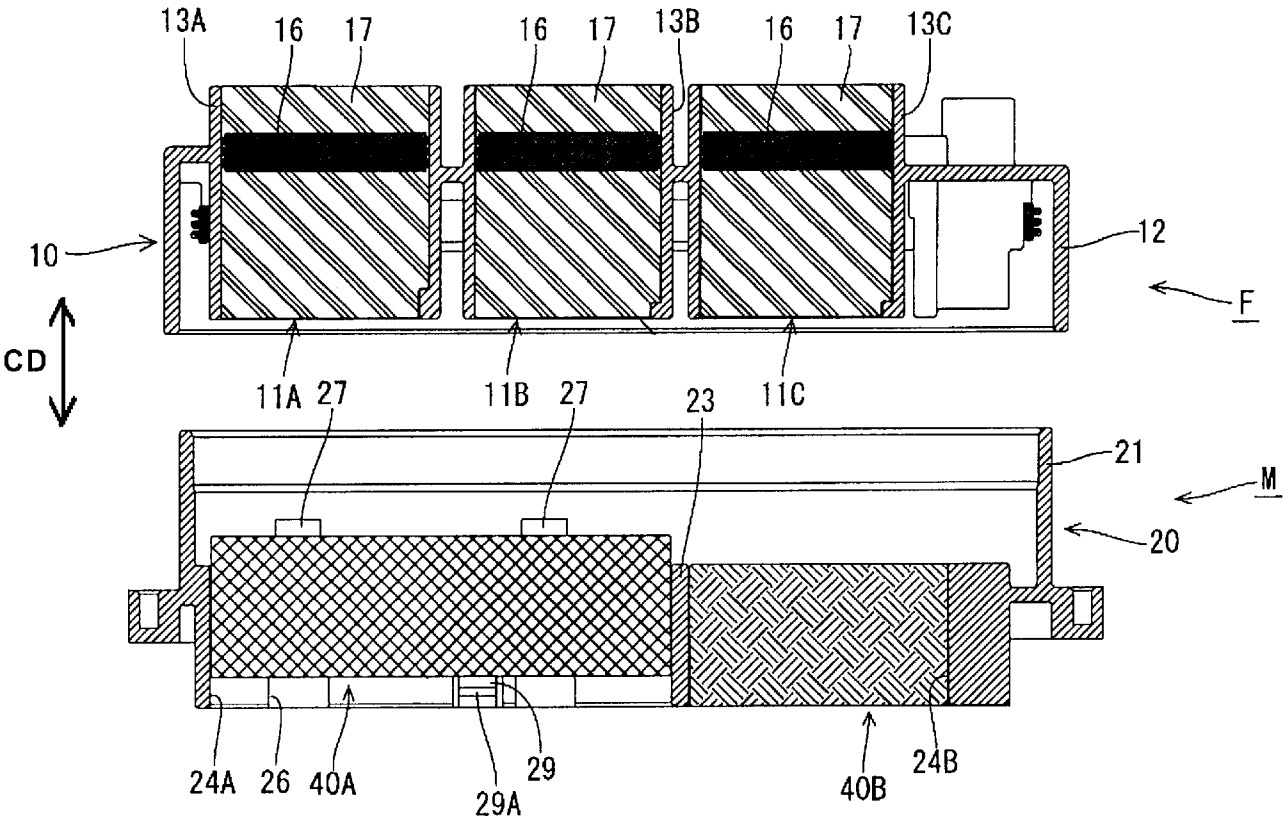
FIG. 2 is a side view in section of the divided connector before being connected.

A connector according to the invention is shown in FIGS. 1 and 2, and comprises a male connector M and a female connector F that are engageable and separable along a connecting direction CD.

The female connector F has a female-side frame 10 made e.g. of a synthetic resin and three female auxiliary connectors 11A–11C made e.g. of a synthetic resin are held in the female-side frame 10. The female-side frame 10 includes a wide tubular receptacle 12 with an open bottom. Vertical lock holes 12A are formed at each of the opposite lateral sides of the receptacle 12. Three rectangular tubular accommodating portions 13A–13C are arranged substantially side by side along the longitudinal direction of the female-side frame 10 and penetrate the upper wall of the receptacle 12. The female auxiliary connectors 11A–11C are accommodated at lower parts of the respective accommodating portions 13A–13C, and sealing rubber plugs 16 and rubber plug pressing members 17 are mounted thereon.

The female auxiliary connectors 11A–11C have substantially rectangular parallelepipedic outer shapes and bottom connecting surfaces thereof are substantially flush with each other when mounted in the respective accommodating portions 13A–13C. The female auxiliary connectors 11A–11C have vertical cavities 14, and female terminal fittings 15 are mounted in the cavities 14. Each female terminal fitting 15 has a terminal connecting portion 15A at one end.

Figure 3:
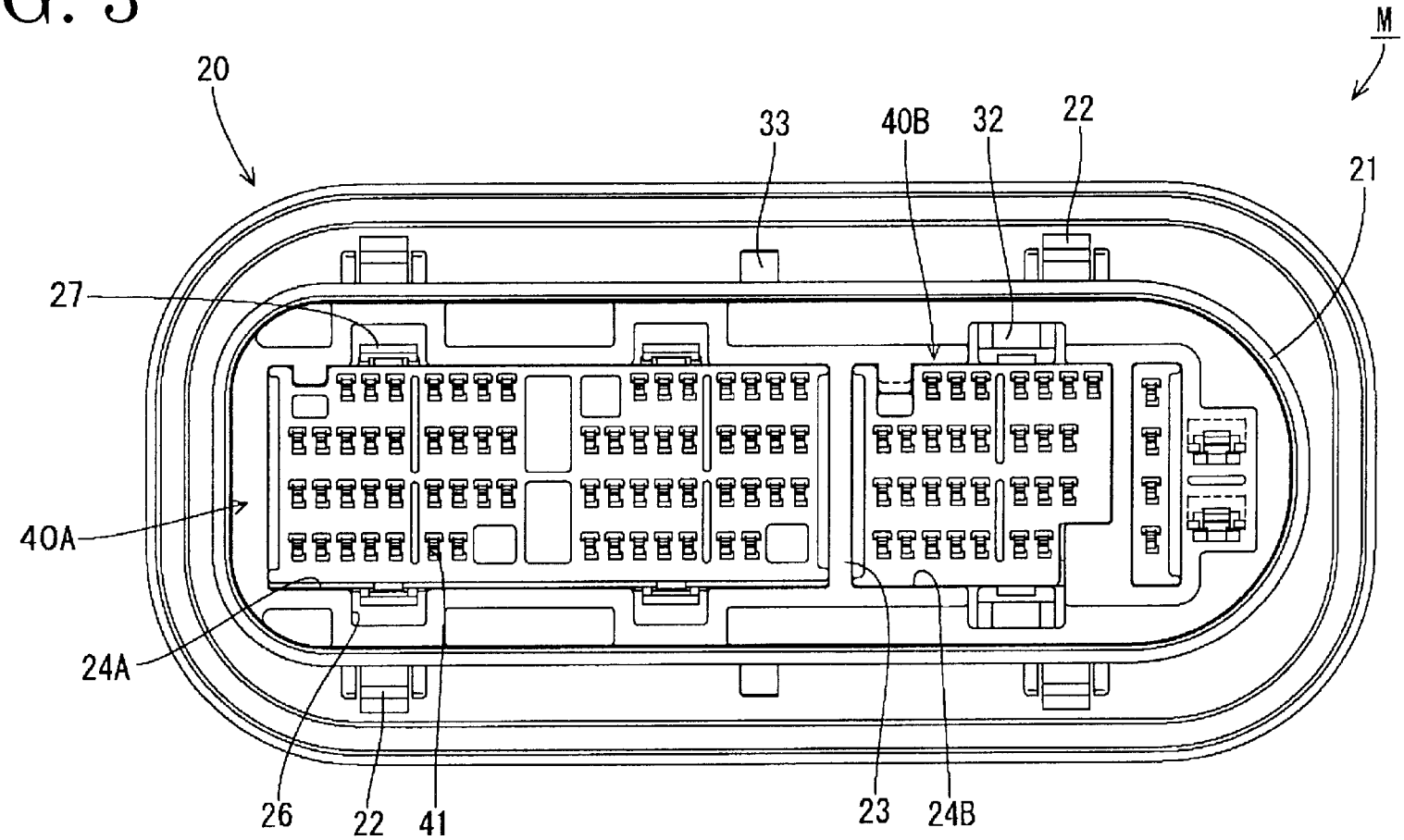
FIG. 3 is a plan view of a male connector.
Figure 4:
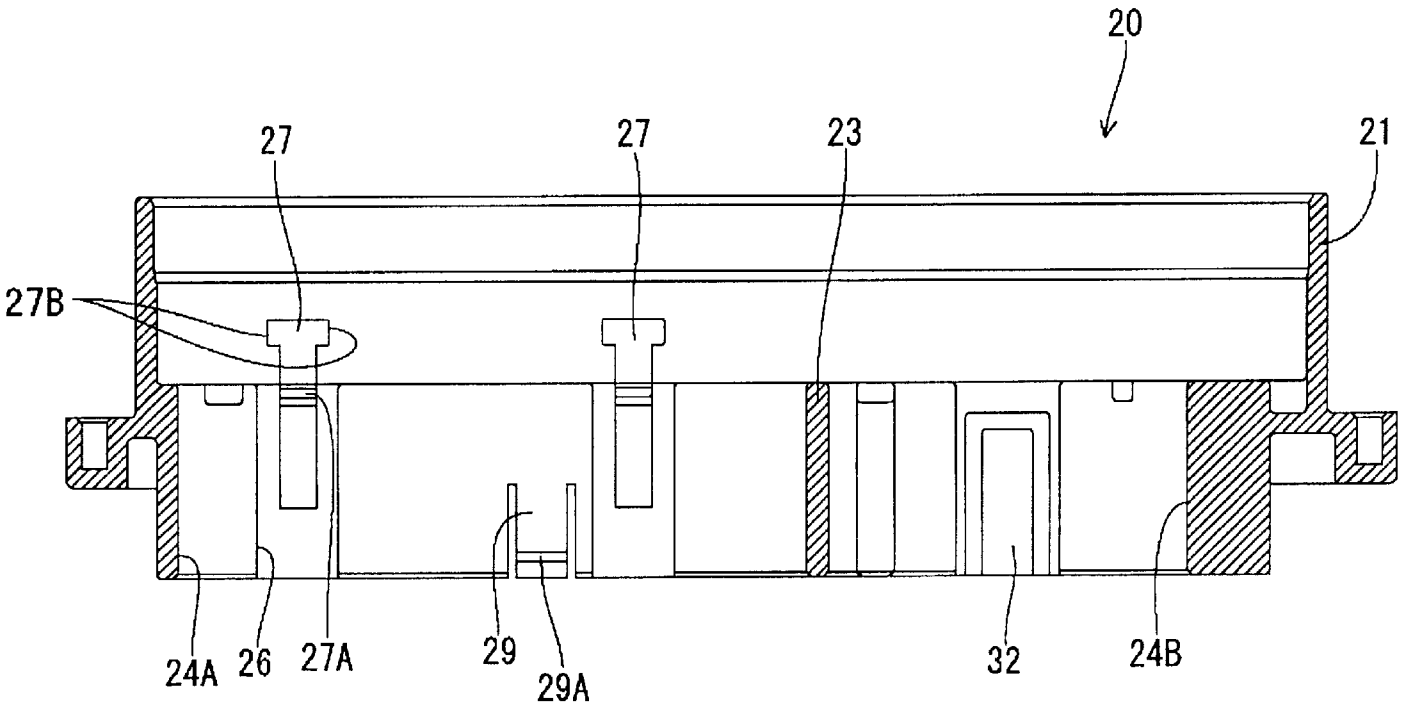
FIG. 4 is a side view in section of a male-side frame.
Figure 5:
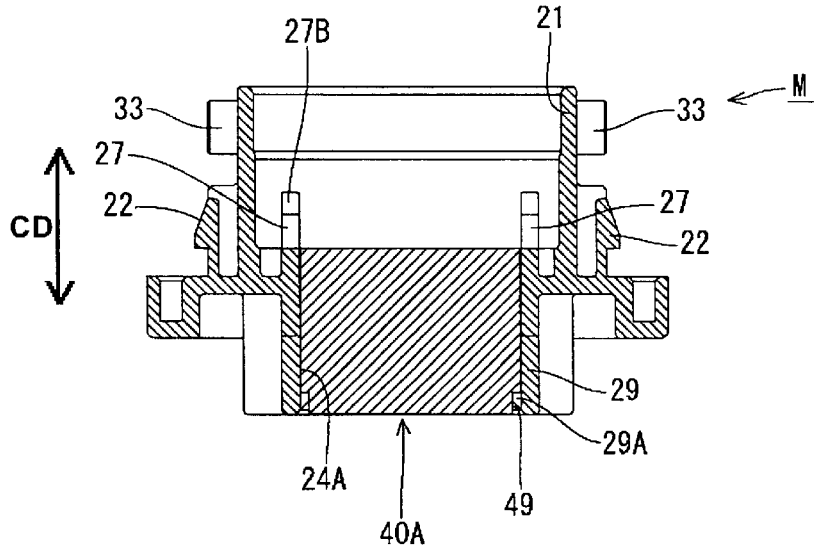
FIG. 5 is a front view in section of a male auxiliary connector mounted at a final mount position.

The male connector M has a male-side frame 20 made e.g. of a synthetic resin and at least two male auxiliary connectors 40A, 40B made e.g. of a synthetic resin are mountable to the male-side frame 20. The male-side frame 20 is narrow and long like the female-side frame 10, as shown in FIGS. 3 to 5. A substantially tubular fittable portion 21 is at the upper left of the male-side frame 20 and is fittable into the receptacle 12. Left and right pairs of resiliently deflectable lock arms 22 project up toward the female connector F on the outer periphery of the fittable portion 21. When the female-side frame 10 and the male-side frame 20 are connected, the lock arms 22 fit into the lock holes 12A and protuberances at their leading ends resiliently engage the opening edges of the lock holes 12A so that the female- and male-side frames 10, 20 are locked into each other.

A rectangular tubular large accommodating portion 24A and a rectangular tubular small accommodating portion 24B open up and down at a lower part of the male-side frame 20 and are partitioned one behind the other by a partition wall 23. The male auxiliary connectors 40A, 40B can be accommodated in the accommodating portions 24A, 24B. Locks 32 are formed on the left and right side walls of the accommodating portion 24B, as shown in FIG. 3, for locking the male auxiliary connector 40B in the accommodating portion 24B. Vertically extending recesses 26 are formed in each of the left and right side walls of the accommodating portion 24A. An L-shaped resilient lock 27 is formed inside each recess 26, and a leading end thereof extends up into the fittable portion 21. A partial locking projection 27A is near the vertical center of each resilient lock 27 and projects toward the inside of the accommodating portion 24A. Wings 27B project laterally from the leading end of each resilient lock 27 to widen the resilient lock 27. Cuts extend up from the bottom end of the left and right side walls of the accommodating portion 24A at a total of three positions, and a resiliently deformable lock 29 is formed between two cuts. A locking projection 29A is formed at the leading end of each lock 29 and projects into the accommodating portion 24A. The bottom surface of each locking projection 29A is tapered toward the bottom end.

A lever (not shown) is pivotally or movably supported on the female-side frame 10, and follower pins 33 project from the side surfaces of the male-side frame 20 for engagement with cam grooves formed in the lever. The male-side frame 20 is pulled toward the female-side frame 10 by the cam action effected by operating the lever, thereby connecting or assisting the connection of the female and male connectors F, M.

The male auxiliary connectors 40A, 40B have substantially rectangular parallelepipedic outer shapes, as shown in FIGS. 1 to 3, and have vertical and lateral dimensions that are substantially the same. However, the male auxiliary connector 40A is about twice as large, as the male auxiliary connector 40B in forward and backward directions. Both male auxiliary connectors 40A, 40B have cavities 41 at positions substantially corresponding to the respective cavities 14 of the mating male auxiliary connectors 11A–11C. Male terminal fittings 43 are mountable in the respective cavities 41 and have tabs 43A that project up toward a position where the female terminal fittings 15 are to be positioned. Lock projections 44 project from left and right side walls of the male auxiliary connector 40B, and the male auxiliary connector 40B is held in the accommodating portion 24B by engaging the lock projections 44 with the locks 32 of the accommodating portion 24B.

Locking projections 46 are formed at the leading end of each locking piece 29 for engagement with the corresponding resilient locks 27 from below. Locking projections 47 are provided near the front ends of the left and right side walls of the male auxiliary connector for engaging the partial locking projections 27A of the respective resilient locks 27.

The male auxiliary connectors 40A are mounted for displacement between a final mount position, where the entire main body thereof is accommodated completely in the accommodating portion 24A, and a partial locking position located above the final mount position with respect to a connecting direction CD. The main body of the male auxiliary connector 40A projects from the accommodating portion 24A toward the fittable portion 21, as shown in FIGS. 1 and 2, when the male auxiliary connector 40A is at the partial locking position. Additionally, the locking projections 46 engage the resilient locks 27 from below and the locking projections 47 are engaged with the partial locking projections 27A from above to lock the male auxiliary connector 40A. Upper and lower surfaces of the locking projections 47 and the partial locking projections 27A are slanted with a moderate angle of inclination. The resilient locks 27 are guided by the slanted surfaces and deform outwardly when an external force acts to push the male auxiliary connector 40A further in the connecting direction CD from the partial locking position where the locking projections 47 where the locking projections 47 are engaged with the partial locking projections 27A from above, thereby unlocking the male auxiliary connector 40A. In other words, the resilient locks 27 form a semi-locking mechanism for the male auxiliary connector 40A.

Figure 9:
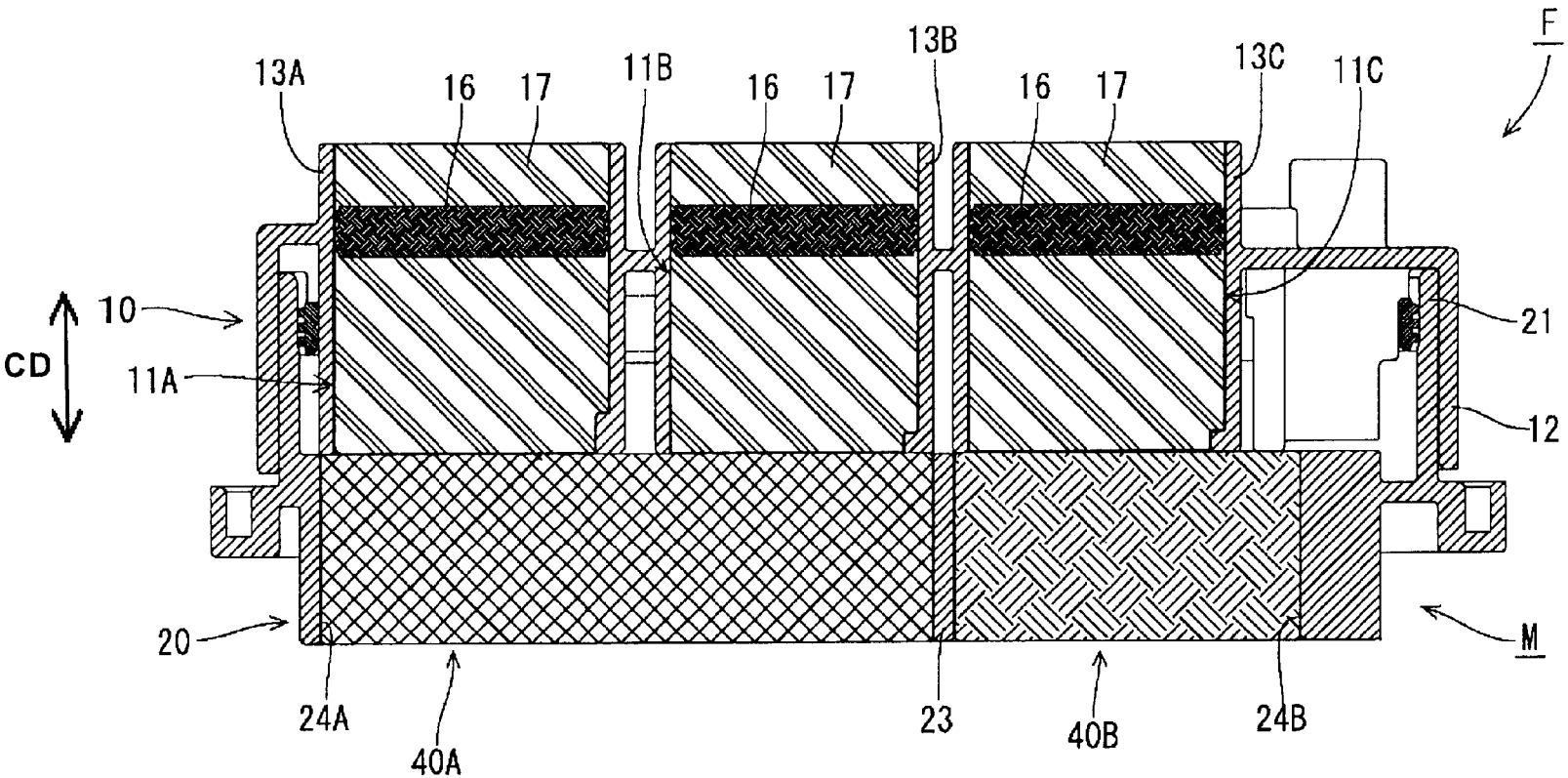
FIG. 9 is a side view in section showing the state where the female and male connectors are completely connected.

The main portion of the male auxiliary connector 40A is in the accommodating portion 24A when the male auxiliary connector 40A is at the final mount position, and the upper connecting surface is flush with that of the male auxiliary connector 40B as shown in FIGS. 5 and 9. At the final mount position, the male auxiliary connector 40A is locked by engaging the locking projections 29A of the locks 29 with locking recesses 49 at the bottom of the male auxiliary connector 40A from inside (FIG. 5).

Figure 6:
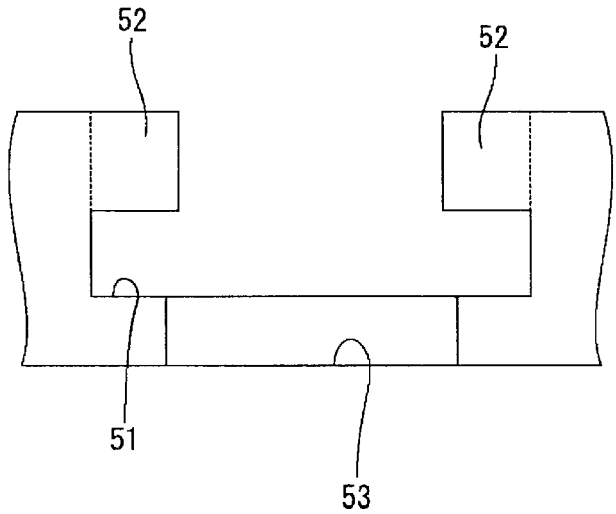
FIG. 6 is an enlarged view of an insertion opening of an insertion groove.
Figure 7:
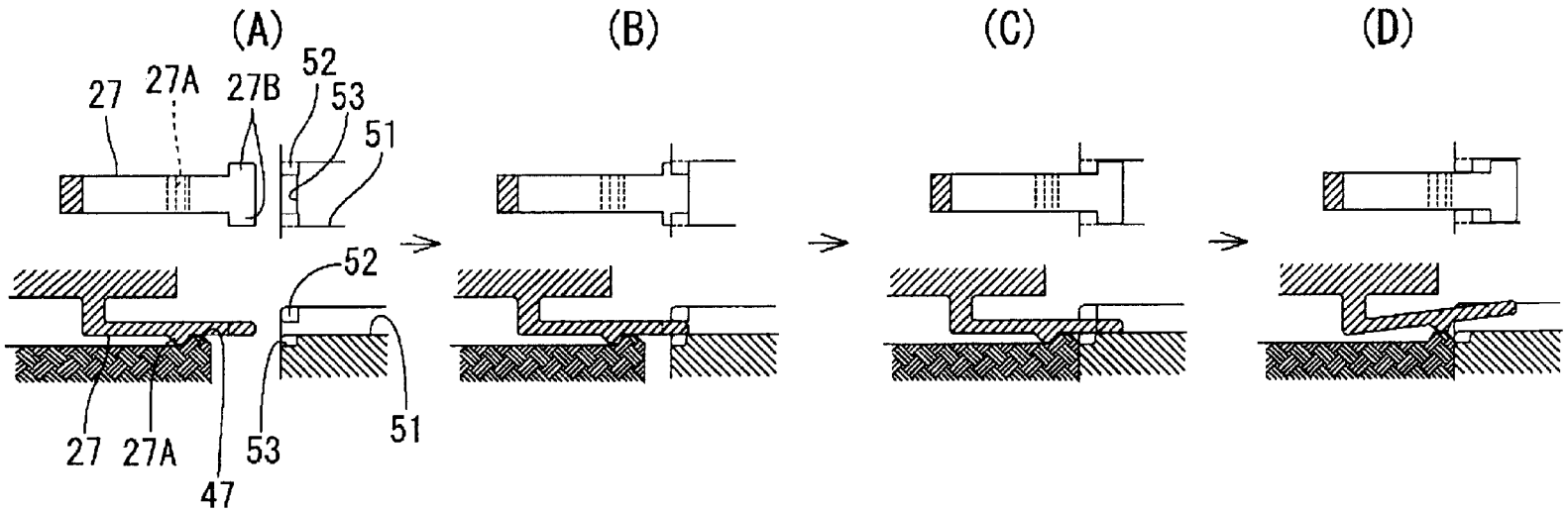
FIGS. 7(A) to 7(D) are sections showing a movement of a resilient locking piece.

Insertion grooves 51 are formed in the walls of the accommodating portions 13A, 13B of the female-side frame 10 at positions to receive the leading ends of the resilient locks 27 of the male-side frame 20, as shown in FIGS. 1, 6 and 7. The grooves 51 are slightly wider than the leading ends of the resilient locks 27. Unlock preventing portions 52 project from the opposite side walls at an insertion opening of each groove 51, and the resilient lock 27 is held between the unlock preventing portions 52 and the bottom of the groove 51. Hence, the resilient lock 27 cannot deform. The wings 27B move beyond the unlock preventing portions 52 when the leading ends of the resilient locks 27 are inserted into the grooves 51 by a specified length. Thus, the resilient locks 27 can deform, as shown in FIG. 7D. Further, an escaping portion 53 is formed in the bottom surface of each groove 51 at the insertion opening for accommodating the partial locking projection 27A.

The male auxiliary connector 40B is fit into the accommodating portion 24B of the male-side frame 20 in the connecting direction CD from below to begin assembly of the connector. Thus, the lock projections 44 engage the lock pieces 32 to hold the male auxiliary connector 40B.

The male auxiliary connector 40A then is fit into the accommodating portion 24A in the connecting direction CD from below and abuts against the locking projections 29A. The slanted surfaces cause the locks 29 to deform resiliently outwardly, and permit further movement of the male auxiliary connector 40A. The locks 29 restore substantially to their original shape when the male auxiliary connector 40A reaches the final mount position in the accommodating portion 24A, and the locking projections 29A fit into the locking recesses 49 to prevent the male auxiliary connector 40A from coming out downwardly.

When the male auxiliary connector 40A is moved beyond the final mount position, the locking projections 47 abut against the partial locking projections 27A and the slanted surfaces of the projections 47, 27A deform the resilient locks 27 outward in the widthwise direction of the male-side frame 20. As a result, the partial locking projections 27A move onto the locking projections 47.

The resilient locks 27 are restored to their original shape and the locking projections 47 engage the partial locking projections 27A from above (see FIGS. 1 and 2) when the male auxiliary connector 40A reaches the partial locking position. Engagement of the locking projections 46 with the rear ends of the resilient locks 27 prevents the male auxiliary connector 40A from coming out upward.

The female and male connectors F, M are connected by first inserting the fittable portion 21 into the receptacle 12. The male-side frame 20 then is pulled toward the female-side frame 10 by engaging the follower pins 33 of the male-side frame 20 with the cam grooves of the unillustrated lever of the female-side frame and operating the lever as described above. The tabs 43A of the male terminal fittings 43 that project from the male auxiliary connector 40A enter the cavities 14 of the corresponding female auxiliary connectors 11A, 11B and engage the resilient contacts of the terminal connecting portions 15A. On the other hand, the leading ends of the resilient locks 27 enter the insertion grooves 51. However, the unlock preventing portions 52 restrict deformation of the resilient locks 27 (see FIG. 7(B)). At or near this time, the male auxiliary connector 40A is subjected to a pushing force acting toward the back side in the connecting direction CD due to a connection resistance of the female and male terminal fittings 15, 43 resulting from an approaching movement of the female auxiliary connectors 11A, 11B. Additionally, the resilient locks 27 are subjected to a force acting outward in the widthwise direction of the female-side frame 10 due to the slanted surfaces of the partial locking projections 27A and the locking projections 47. However, the wings 27B are engaged with the unlock preventing portions 52. Thus, the resilient deformation of the resilient locks 27 is prevented, and the male auxiliary connector 40A remains held at the partial locking position.

The female auxiliary connectors 11A, 11B abut against the male auxiliary connector 40A when the female and male connectors F, M are connected further. Thus, the wings 27B move beyond the unlock preventing portions 52 to free the resilient locks 27, which then are permitted to undergo a resilient deformation (see FIG. 7(C)). In this way, the male auxiliary connector 40A and the female auxiliary connectors 11A, 11B are connected completely.

Figure 8:
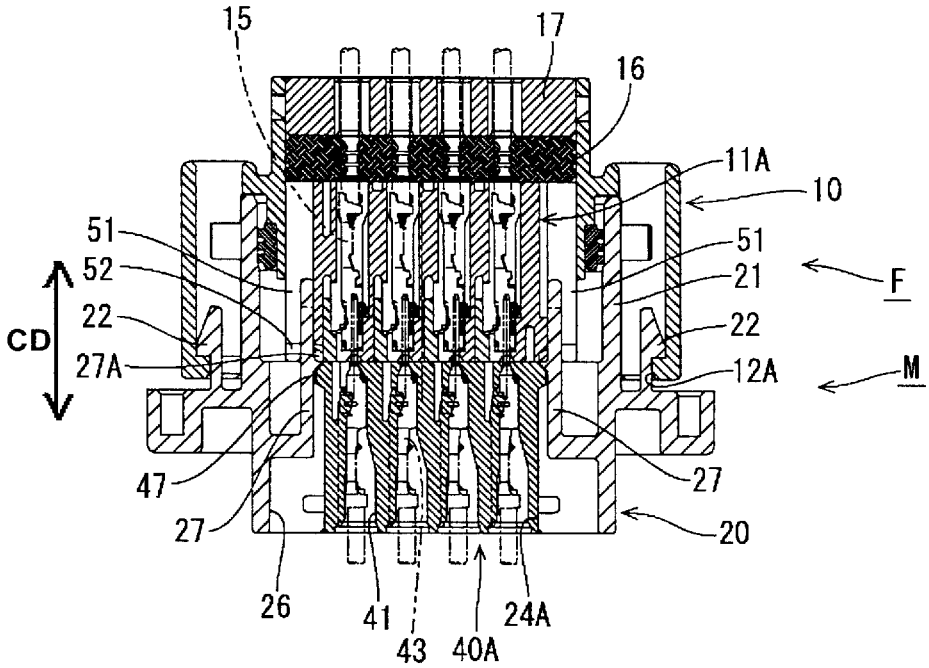
FIG. 8 is a front view in section showing a state where female and male connectors are completely connected.

Further connection of the female and male connectors F, M causes the female auxiliary connectors 11A, 11B to push the male auxiliary connector 40A. Thus, the resilient locks 27 are guided by the slanted surfaces of the partial locking projections 27A and the locking projections 47 and deform resiliently outward with respect to the widthwise direction of the male-side frame 20. As a result, the partial locking projections 27A move onto the locking projections 47 (see FIG. 7(D)). The male auxiliary connector 40A then is moved toward the back side with respect to the connecting direction CD together with the female auxiliary connectors 11A, 11B. Subsequently, the tabs 43A that project from the male auxiliary connector 40B enter the cavities 14 of the corresponding female auxiliary connector 11C, thereby starting the connection with the female terminal fittings 15. The female auxiliary connector 11C abuts against the male auxiliary connector 40B, and the lock arms 22 of the male-side frame 20 engage the edges of the lock holes 12A of the female-side frame 10. Thus the female and male connectors F, M are locked inseparably into each other (see FIGS. 8 and 9). At this time, the male auxiliary connector 40A is at the final mount position, and the locking projections 29A engage the locking recesses 49 from inside. The partial locking projections 27A of the resilient locks 27 move over the locking projections 47 and the resilient locks 27 are restored to their original shape so that the partial locking projections 27A enter the escaping portions 53. In this way, the auxiliary connectors 40B, 11C are connected completely, and the female and male connectors F, M are connected properly with each other.

As described above, one male auxiliary connector 40A is mounted displaceably into the male-side frame 20 along the connecting direction CD, is held at the partial locking position with respect to the connecting direction CD by the resilient locks 27, and is connected with the mating female auxiliary connectors 11A, 11B prior to the other male auxiliary connector 40B. Upon completion of this connection, partial locking by the resilient locks 27 is cancelled. Thus, the other male auxiliary connector 40B is connected while the male auxiliary connector 40A is displaced to the back side with respect to the connecting direction CD. By connecting the male auxiliary connectors 40A, 40B with the mating side at different positions, a peak value of the connecting force can be reduced.

Further, the resilient locks 27 are formed on the inner surface of the accommodating portion 24A of the male-side frame 20. Thus, the male auxiliary connector 40A is simple and small as compared to a case where resilient locks are on the male auxiliary connector.

The male auxiliary connector 40A is held temporarily at the partial locking position (FIGS. 1, 2) during connection with the mating female auxiliary connectors 11A, 11B because the unlock preventing portions 52 of the female-side frame 10 prevent the resilient deformation of the resilient locks 27 in unlocking direction. However, the resilient locks 27 disengage from the unlock preventing portions 52 and deform resiliently in unlocking direction when the female auxiliary connectors 11A, 11B are connected completed, thereby freeing the male auxiliary connector 40A. The construction is simple because the resilient locks 27 act both as the semi-locking mechanism and as the holding means for the male auxiliary connector 40A.

A further embodiment of the invention is described with reference to FIGS. 10 to 22, and comprises a male connector M and a female connector F that are engageable and separable along a connecting direction CD.

The female connector F has a female-side frame 10 made of a synthetic resin, and three female auxiliary connectors 11A to 11C made e.g. of a synthetic resin are held in the female-side frame 10. The female-side frame 10 includes a wide tubular receptacle 12 with an open bottom. A transverse edge of the receptacle 12 defines a flange, and lock holes 12A are formed in the flange. Three open-ended rectangular tubular accommodating portions 13A–13C are arranged substantially side by side along the longitudinal direction of the frame 10 and penetrate the upper wall of the receptacle 12. The female auxiliary connectors 11A–11C are accommodated at lower parts of the respective accommodating portions 13A–13C.

The female auxiliary connectors 11A–11C have substantially rectangular parallelepipedic outer shapes and are held in the accommodating portions 13A–13C by unillustrated locking means. The female auxiliary connectors 11A–11C mounted in the female-side frame 10 have their bottom connecting surfaces substantially flush with each other. The respective female auxiliary connectors 11A–11C have vertically aligned cavities 14, and female terminal fittings (not shown) are mountable in cavities 14. Each female terminal fitting has a terminal connecting portion at one end.

Figure 12:
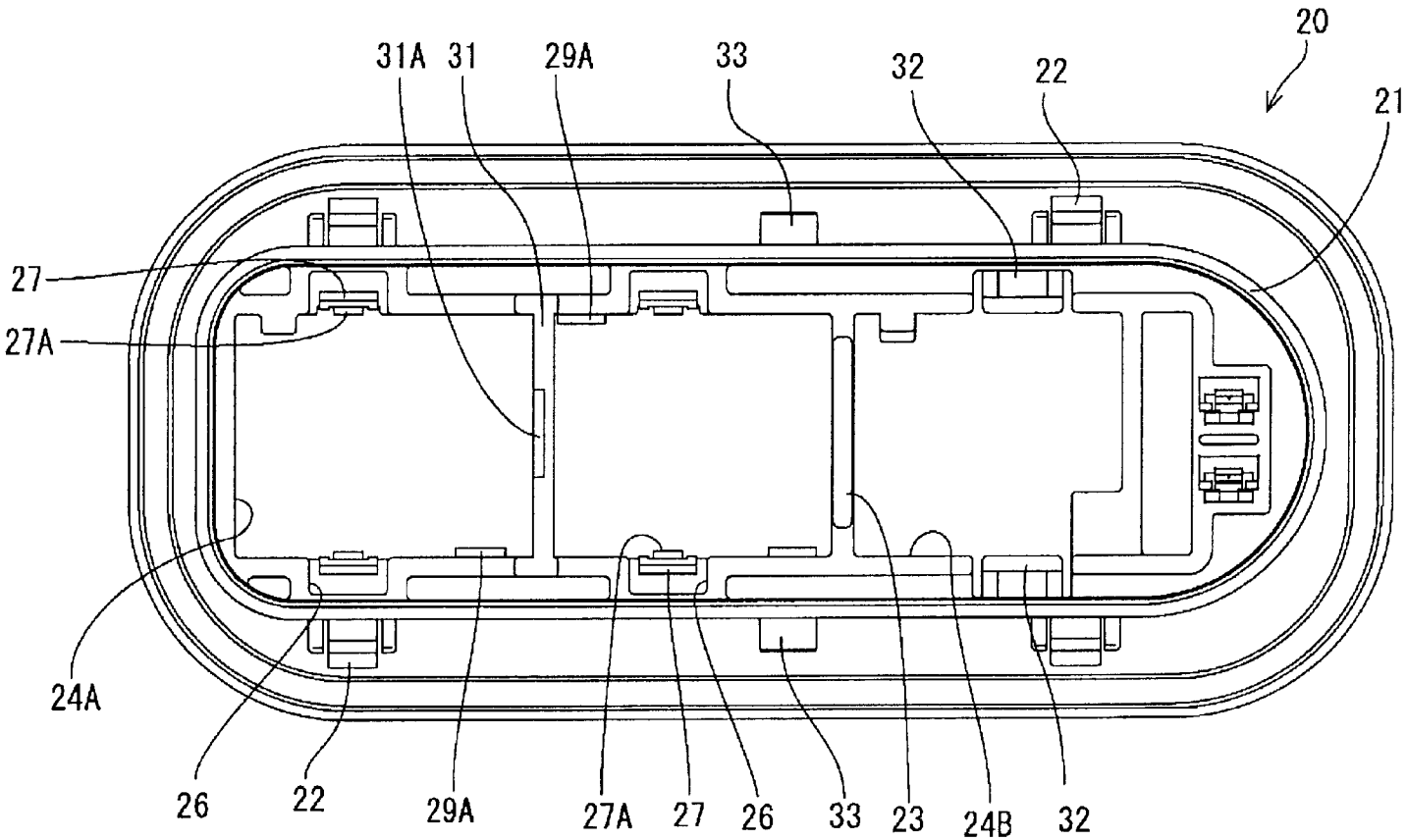
FIG. 12 is a plan view of a male frame.
Figure 13:
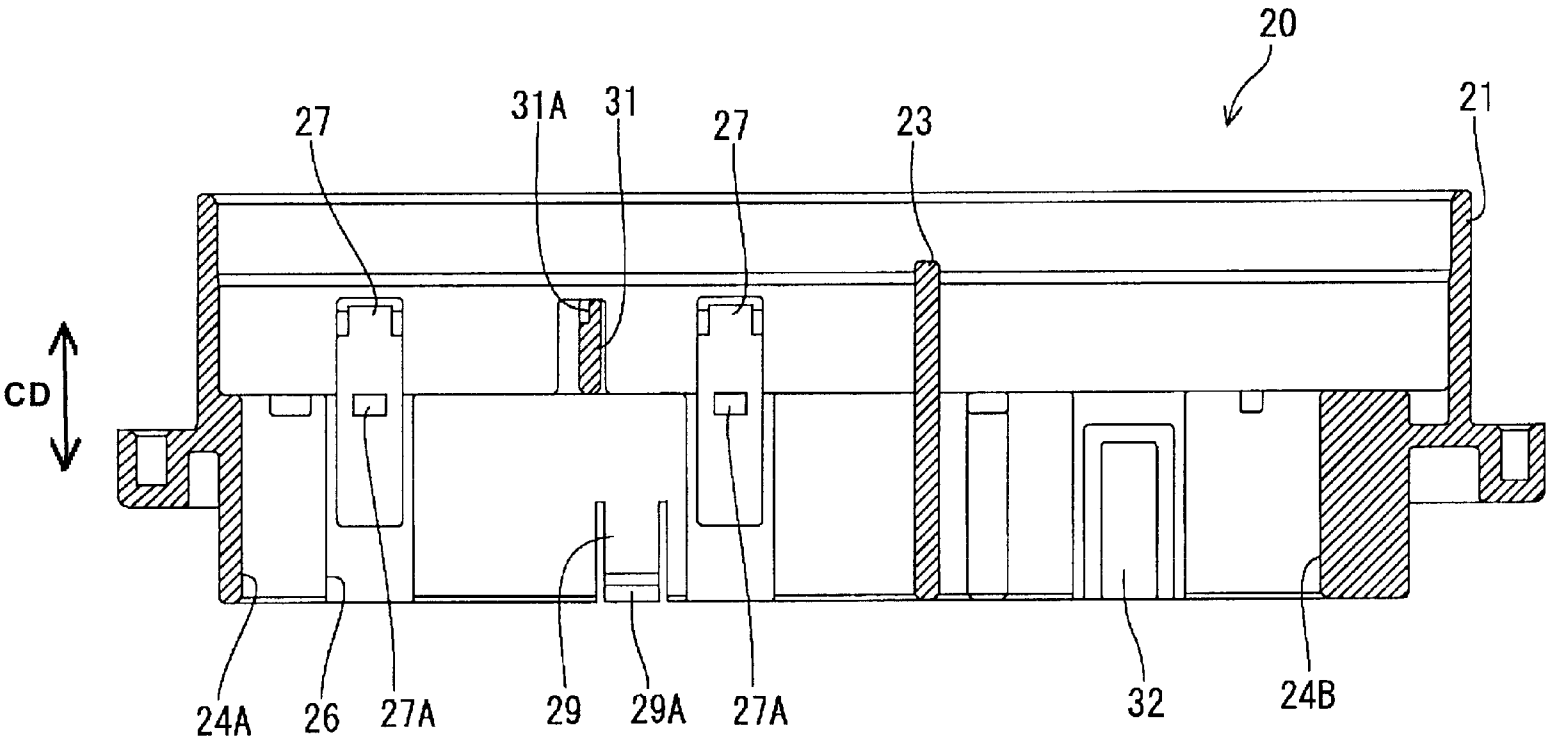
FIG. 13 is a side view in section of a male-side frame.
Figure 14:
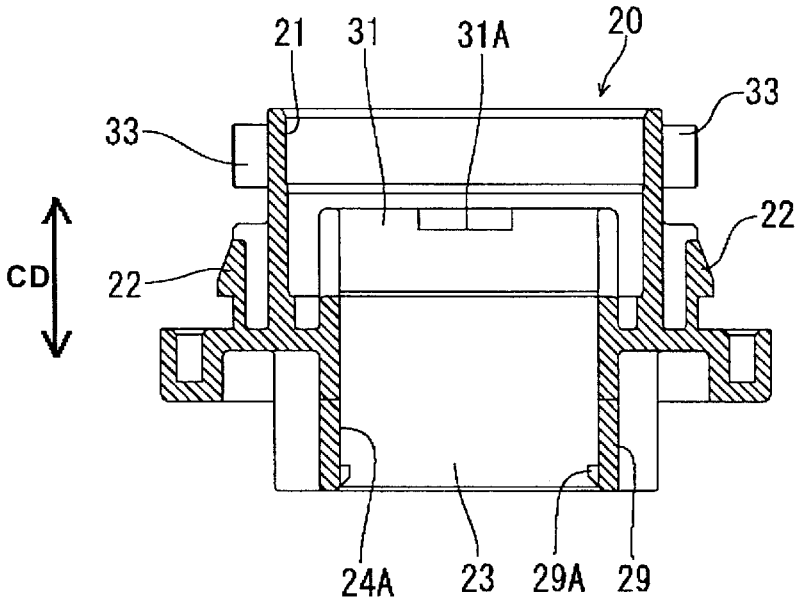
FIG. 14 is a front view in section of the male-side frame.

The male connector M has a male-side frame 20 made e.g. of a synthetic resin and two male auxiliary connectors 40A, 40B made e.g. of a synthetic resin are held in the male-side frame 20. The male-side frame 20 is long and narrow like the female-side frame 10, as shown in FIGS. 12 to 14, and has a substantially tubular fittable portion 21 that can be fit into the receptacle 12. Resiliently deflectable lock arms 22 project up toward the female connector F on the outer periphery of the fittable portion 21. The lock arms 22 fit into the lock holes 12A and protuberances at their leading ends engage edges of the lock holes 12A when the female-side frame 10 and the male-side frame 20 are connected, so that the female- and male-side frames 10, 20 are locked into each other.

Large and small rectangular tubular accommodating portions 24A and 24B open upwardly and downwardly at a lower part of the male-side frame 20 and are partitioned one behind the other by a partition wall 23. The male auxiliary connectors 40A, 40B can be accommodated in the accommodating portions 24A and 24B. A lock 32 is formed on each of the left and right side walls of the accommodating portion 24B for locking the male auxiliary connector 40B. Vertical recesses 26 are formed in the left and right side walls of the accommodating portion 24A. An L-shaped lock 27 is formed inside each recess 26 (see also FIG. 16), and a leading end portion thereof extends up into the fittable portion 21. The leading ends of the respective locks 27 are resiliently deformable in the widthwise direction of the male-side frame 20. Further, a partial locking projection 27A is provided near a vertical center of each lock 27 and projects toward the inside of the accommodating portion 24A. Cuts extend up from the bottom end of the left and right side walls of the accommodating portion 24A at three positions, and a resiliently deformable lock 29 is formed between two cuts. A locking projection 29A is formed at the leading end of each lock 29 and projects more into the accommodating portion 24A. Each locking projection 29A has a tapered bottom end. A substantially planar restriction receiving portion 31 bridges the left and right walls of the accommodating portion 24A at a center position of the accommodating portion 24 with respect to forward and backward directions, and a restriction recess 31A is formed at the upper end of its front surface.

Although not shown in detail, a lever preferably is pivotally supported on the female-side frame 10, and follower pins 33 project from the side surfaces of the male-side frame 20 for engagement with cam grooves in the lever. The male-side frame 20 is pulled toward the female-side frame 10 by the cam action effected by operating the lever, thereby assisting the connection of the female and male connectors F, M.

Figure 10:
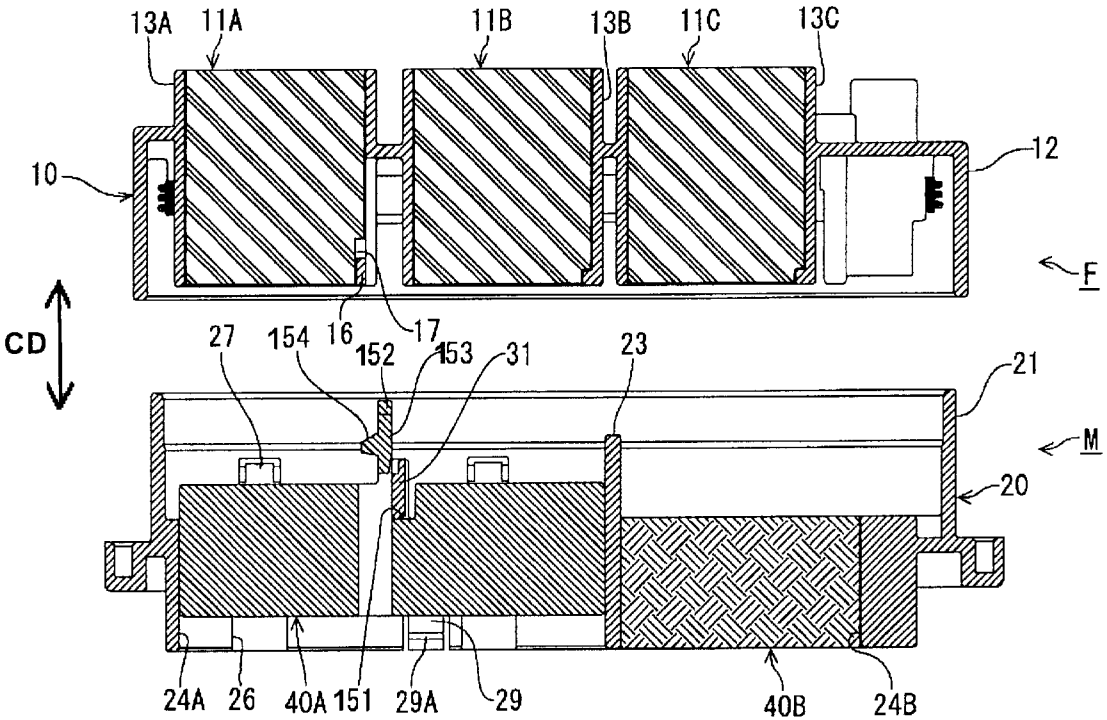
FIG. 10 is a side view in section of a divided connector according to one further preferred embodiment of the invention before being connected (temporary mount position).
Figure 11:
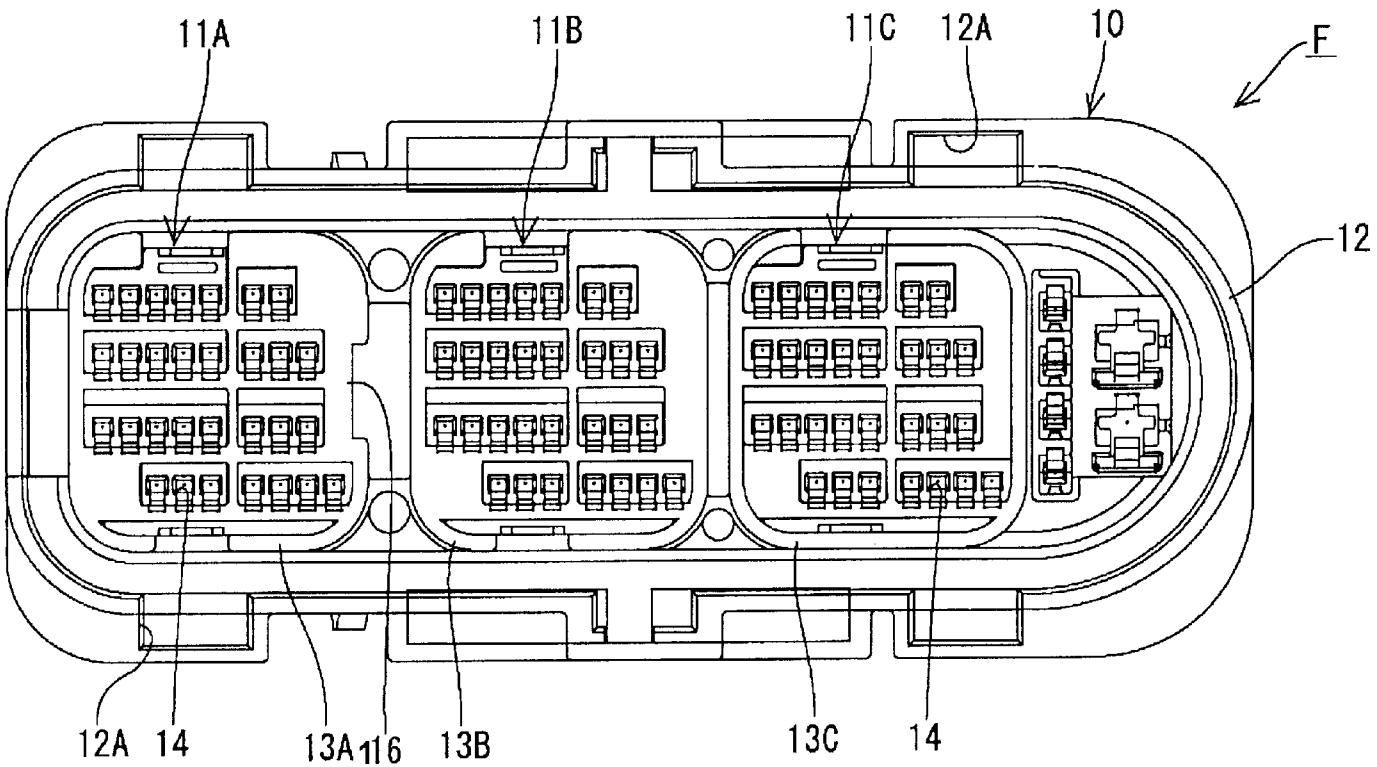
FIG. 11 is a bottom view of a female connector.
Figure 15:
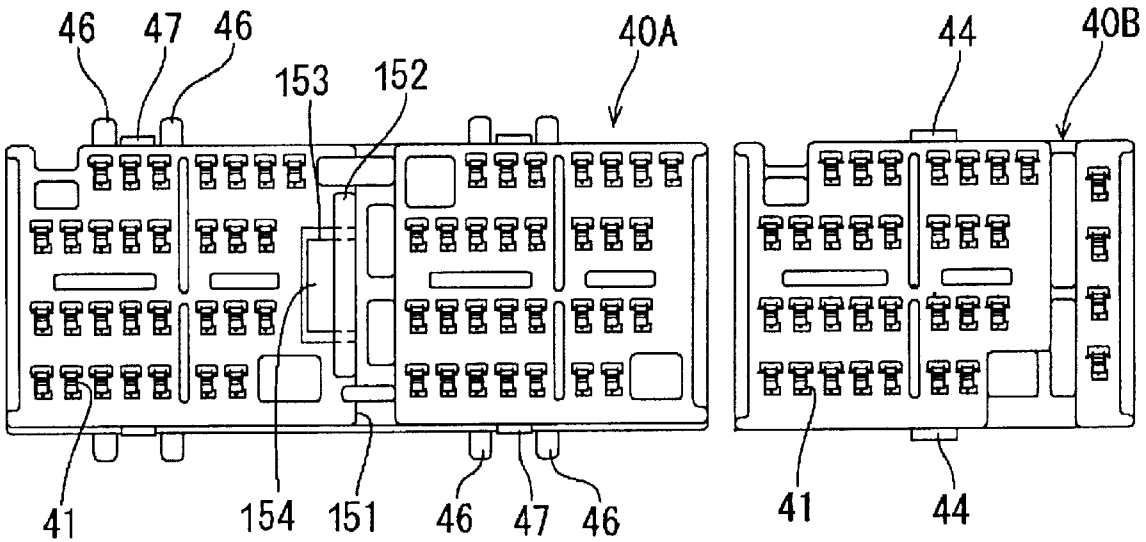
FIG. 15 is a plan view of male auxiliary connectors.
Figure 16:
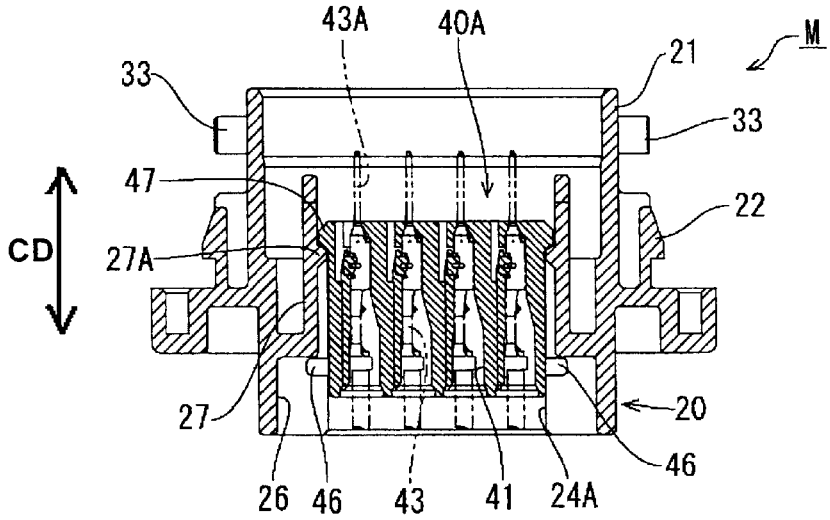
FIG. 16 is a front view in section showing a state where the male auxiliary connector is mounted at a temporary mount position or partial locking position.

The male auxiliary connectors 40A, 40B both have substantially rectangular parallelepipedic outer shapes as shown in FIGS. 10, 15 and 16, and their dimensions in vertical and widthwise directions are substantially the same. However, the male auxiliary connector 40A is about twice as large as the male auxiliary connector 40B in forward and backward directions. Both male auxiliary connectors 40A, 40B have cavities 41 at positions corresponding to the cavities 14 of the mating female auxiliary connectors 11A to 11C, and male terminal fittings 43 are mounted in the cavities 41 such that the tabs 43A thereof project up toward a position where the terminal connection portion 15A is to be positioned. Locks 44 project from the left and right side walls of the male auxiliary connector 40B, and the male auxiliary connector 40B is held in the accommodating portion 24B by the engagement of the locks 44 with the locks 32 of the accommodating portion 24B.

Locks 46 project on each of the left and right side walls of the male auxiliary connector 40A for engagement with the corresponding locks 27 from below. Further, locks 47 are provided near the front ends of the left and right side walls of the male auxiliary connector 40A for engagement with the partial locking projections 27A of the locks 27.

The male auxiliary connector 40A is mounted for displacement between a final mount position, where the entire main body thereof is in the accommodating portion 24A, and a partial locking position located before the final mount position with respect to a connecting direction CD. When the male auxiliary connector 40A is at the partial locking position, the main body of the male auxiliary connector 40A projects from the accommodating portion 24A toward the fittable portion 21, as shown in FIGS. 10 and 16, the locks 46 are engaged with the locks 27 from below and the locks 47 are engaged with the partial locking projections 27A from above to lock the male auxiliary connector 40A. Locking surfaces of the locks 47 and the partial locking projections 27A are slanted with a moderate angle of inclination. The locks 27 are guided by the slanted surfaces to deform resiliently outward when an external force pushes the male auxiliary connector 40A further from the partial locking position where the locks 47 and the partial locking projections 27A are engaged. Thus, the locks 27 disengage from the male auxiliary connector 40A.

Figure 17:
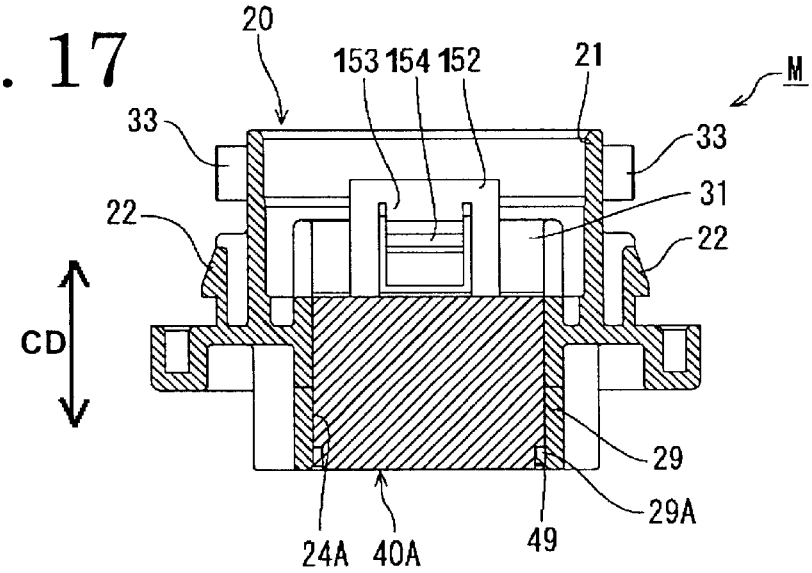
FIG. 17 is a front view in section showing a state where the male auxiliary connector is mounted at a final mount position.
Figure 18:
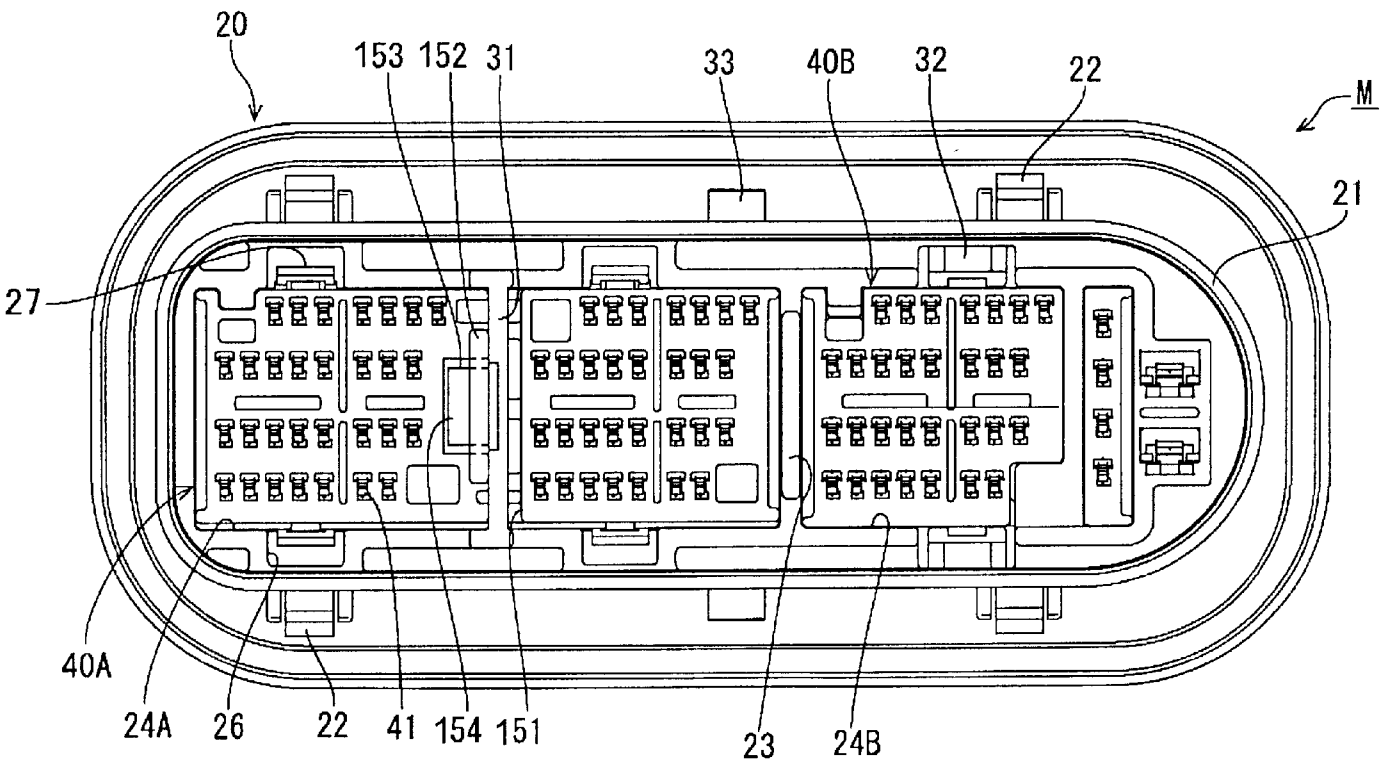
FIG. 18 is a plan view of a male connector.
Figure 19:
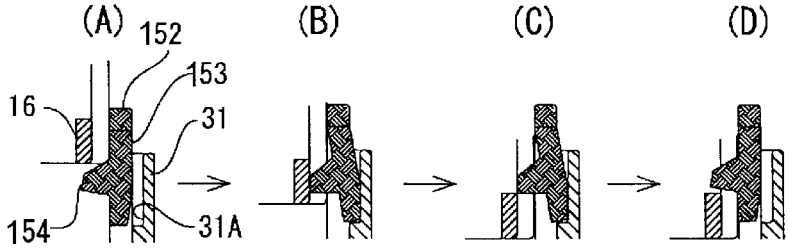
FIGS. 19(A) to 19(D) are side views in section showing a movement of a resilient restricting piece.
Figure 20:
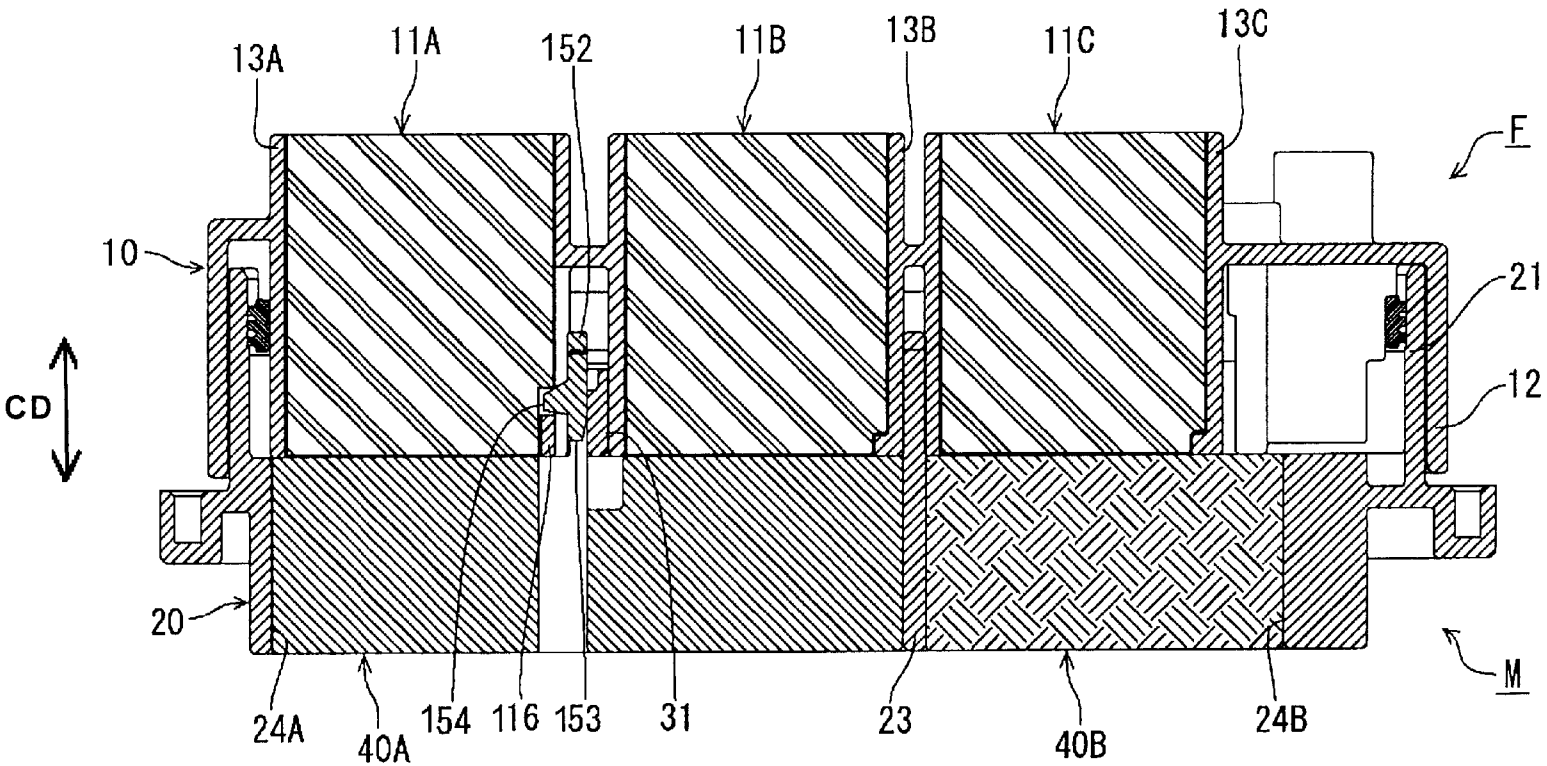
FIG. 20 is a side view in section showing the female and male connectors completely connected.

When the male auxiliary connector 40A is at the final mount position, the main portion thereof is in the accommodating portion 24A and the upper connecting surface is flush with that of the male auxiliary connector 40B, as shown in FIGS. 17 and 20. At the final mount position, the male auxiliary connector 40A is locked by the engagement of the locking projections 29A on the locks 29 with locking recesses 49 at the bottom end of the male auxiliary connector 40A from inside.

A transverse escape groove 151 is formed in the upper surface of the male auxiliary connector 40A at a center position with respect to forward and backward directions. A bottom part of the restriction receiving portion 31 of the male-side frame 20 enters the escape groove 151 when the male auxiliary connector 40A is at the partial locking position. A gate-shaped supporting wall 152 stands up at the front side of the escape groove 151, and a resilient restricting piece 153 extends down from the upper side of the supporting wall 152. This resilient restricting piece 153 is resiliently deformable at substantially a right angle to the connecting direction CD of the female and male connectors F, M, and is engageable with the restriction receiving portion 31 to restrict a downward displacement of the male auxiliary connector 40A when the resilient restricting piece 153 is deformed resiliently backward with the male auxiliary connector 40A located at the partial locking position. Further, a pushable projection 154 with a slanted upper surface is provided on the front surface of the resilient restricting piece 153. During the connection of the female and male connectors F, M, a pusher 16 at the bottom end of the accommodating portion 13A of the female-side frame 10 contacts the pushable projection 154, to deform backward. Further, an escape portion 17 is recessed above the pusher 16, so that the leading end of the pushable projection 154 can enter the escaping portion 17 when the female auxiliary connectors 11A, 11B are connected properly with the male auxiliary connector 40A.

The connector is assembled by first fitting the male auxiliary connector 40B into the accommodating portion 24B of the male-side frame 20 from below until the locks 44 engage the locks 32 to hold the male auxiliary connector 40B. The male auxiliary connector 40A then is fitted into the accommodating portion 40A from below. Sufficient insertion causes the male auxiliary connector 40B to abut against the slanted surfaces of locking projections 29A. As a result, the locks 29 deform resiliently to permit further insertion of the male auxiliary connector 40A. The locks 29 are restored substantially to their original shape when the male auxiliary connector 40A is fitted to the final mount position in the accommodating portion 24A, and the locking projections 29A fit into the locking recesses 49 to prevent the male auxiliary connector 40A from coming out downward.

The male auxiliary connector 40A can be moved up beyond the final mount position. Thus, the locks 47 abut against the partial locking projections 27A and the locks 27 deform resiliently out so that the partial locking projections 27A move onto the locks 47. The locks 27 are restored to their original shape when the male auxiliary connector 40A reaches the partial locking position and the locks 47 engage with the partial locking projections 27A from above (see FIG. 16). On the other hand, the locks 46 engage the rear ends of the locks 27 to preventing the male auxiliary connector 40A from coming out upward.

The female and male connectors F, M are connected by first inserting the fittable portion 21 into the receptacle 12. The male-side frame 20 then is pulled toward the female-side frame 10 by engaging the follower pins 33 of the male-side frame 20 with the cam grooves of the unillustrated lever of the female-side frame and operating the lever as described above. The pushable projection 154 first contacts the pusher 16 of the female-side frame 10 (see FIG. 19), thereby resiliently deforming the resilient restricting piece 153 back and fitting it into the restriction recess 31A of the restriction receiving portion 31. The tabs 43A of the male terminal fittings 43 then enter the cavities 14 of the corresponding female auxiliary connectors 11A, 11B and engage the contacts of the terminal connecting portions of the female terminal fittings. The male auxiliary connector 40A is subjected to a pushing force acting toward the back side in the connecting direction CD due to a connection resistance of the female and male terminal fittings resulting from an approaching movement of the female auxiliary connectors 11A, 11B. However, the resilient restricting piece 153 is engaged with the restriction receiving portion 31. Thus, the male auxiliary connector 40A remains at the partial locking position. The connection of the female and male connectors F, M advances further so that the pushable projection 154 slides over and passes the outer surface of the pusher 16 while being held in contact therewith (see FIG. 19(B)). The female auxiliary connectors 11A, 11B reach a position where they abut against the male auxiliary connector 40A and the pushable projection 154 moves beyond the pusher 16 (see FIG. 19(C)). Thus, the resilient restricting piece 153 is restored to its original shape and the leading end of the pushable projection 154 enters the escaping portion 17 (see FIG. 19(D)). In this way, the connection of the male auxiliary connector 40A and the female auxiliary connectors 11A, 11B is completed with the male auxiliary connector 40A freed from restriction.

As the connection of the female and male connectors F, M proceeds, the male auxiliary connector 40A is pushed by the female auxiliary connectors 11A, 11B and moves with the female auxiliary connectors 11A, 11B to the back side with respect to the connecting direction CD. The tabs 43A that project from the male auxiliary connector 40B then enter the cavities 14 of the corresponding female auxiliary connector 11C, thereby starting the connection with the female terminal fittings 15. The connection of the auxiliary connectors 40B, 11C is complete when the female auxiliary connector 11C abuts the male auxiliary connector 40B. As a result, the female and male connectors F, M are connected properly, as shown in FIG. 20. At this time, the lock arms 22 of the male-side frame 20 engage the edges of the lock holes 12A of the female-side frame 10 to lock the female and male connectors F, M into each other. The male auxiliary connector 40A is at the final mount position and the locking projections 29A engage the locking recesses 49 from inside.

As described above, one male auxiliary connector 40A is held at the partial locking position by the resilient restricting piece 153 and the restriction receiving portion 31, and is connected with the mating female auxiliary connectors 11A, 11B prior to the other male auxiliary connector 40B. Upon the completion of this connection, the auxiliary connector 40A is freed from the resilient restricting piece 153 and the restriction receiving portion 31. The other male auxiliary connector 40B then is connected while the male auxiliary connector 40A is displaced to the back side with respect to the connecting direction CD. Connecting the male auxiliary connectors 40A, 40B with the mating side at different positions reduces the peak connecting force.

The resilient restricting piece 153 in the male auxiliary connector 40A engages the restriction receiving portion 31 in the male-side frame 20 to restrict displacement of the male auxiliary connector 40A to the back side with respect to the connecting direction CD while the male auxiliary connector 40A is being connected with the female auxiliary connectors 11A, 11B. Upon the completion of this connection, the resilient restricting piece 153 is restored towards its original shape and disengages from the restriction receiving portion 31, thereby permitting the displacement of the male auxiliary connector 40A.

Figure 21:
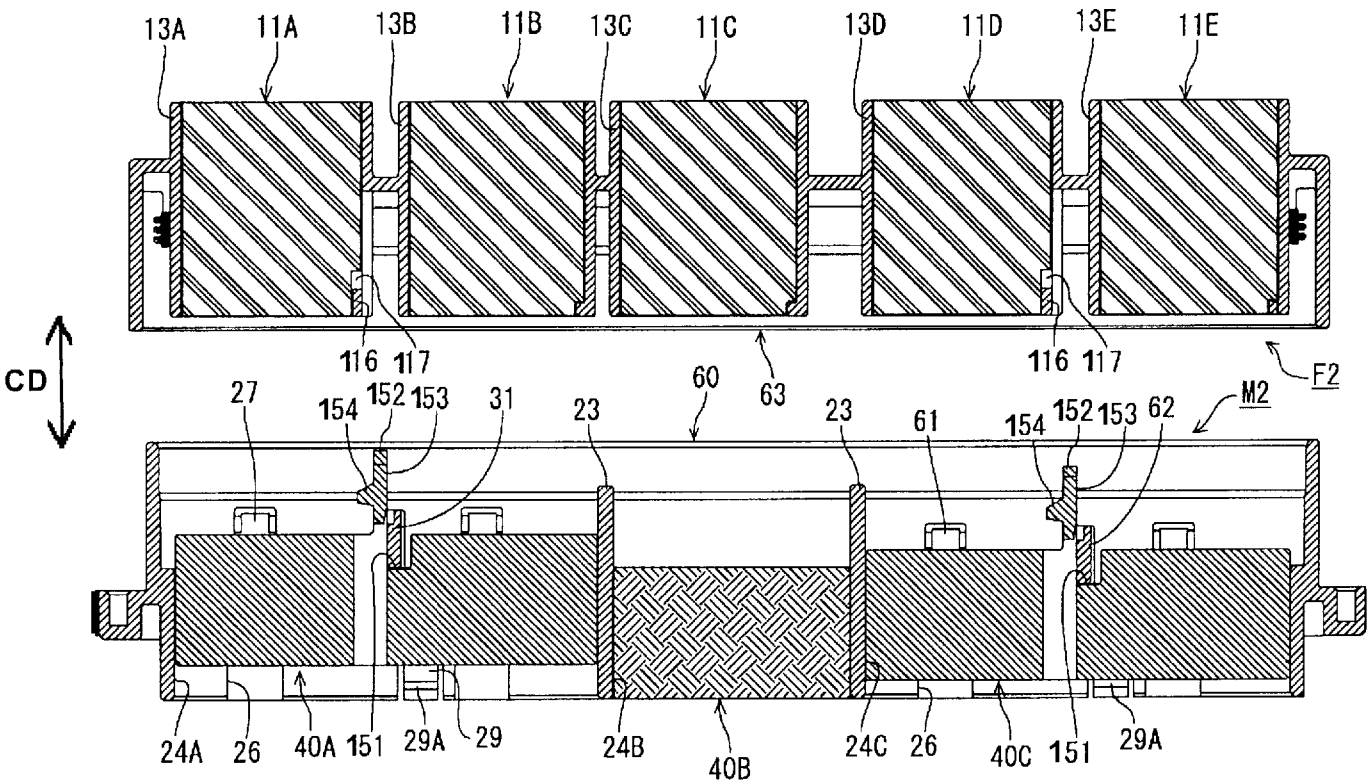
FIG. 21 is a side view in section showing a divided connector according to still a further preferred embodiment before being connected (temporary mount position).
Figure 22:
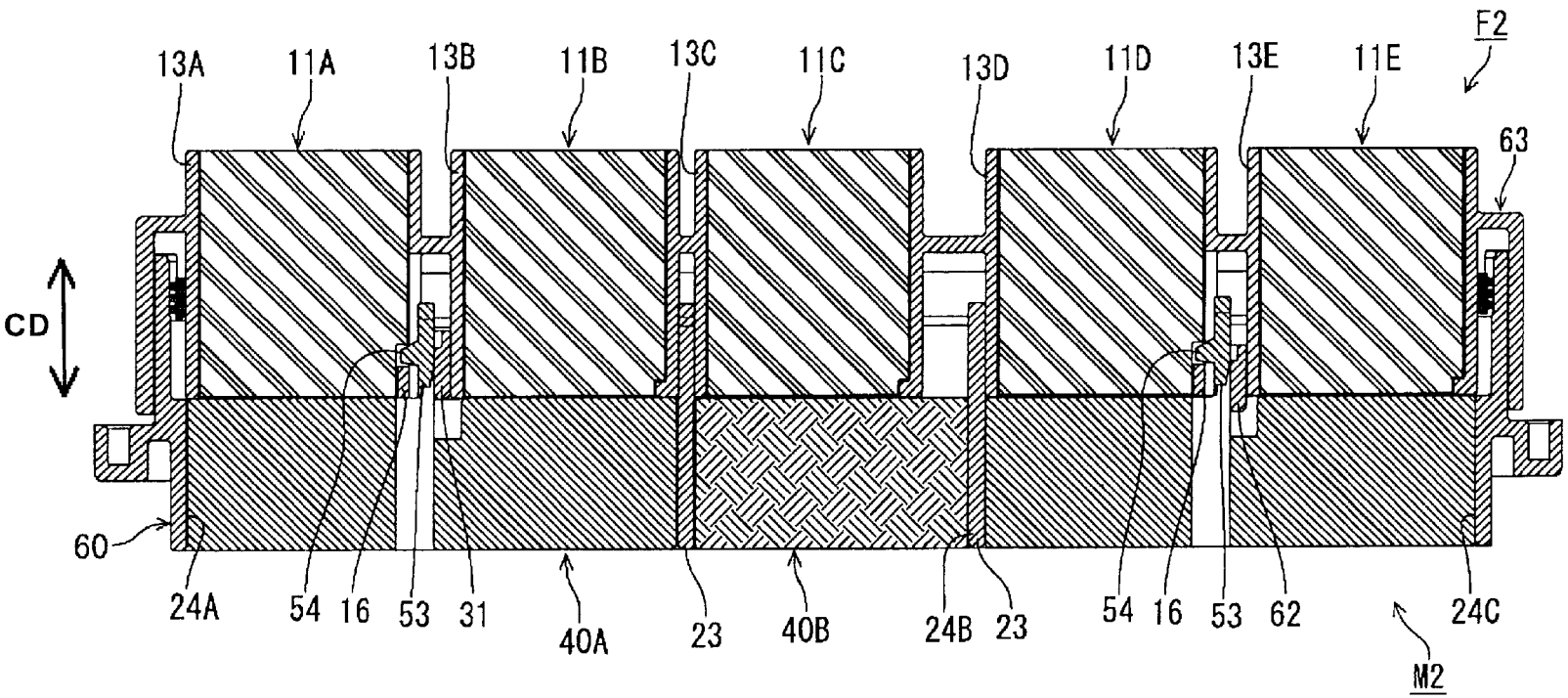
FIG. 22 is a side view showing a connected state.

A further embodiment of the invention is described with reference to FIGS. 21 and 22. No description is given on the construction substantially the same as that of the previous embodiments by identifying it by the same reference numerals.

A male connector M2 of this embodiment has three accommodating portions 24A to 24C arranged substantially side by side in a male-side frame 60. Similar to the first embodiment, the male auxiliary connectors 40A, 40B are accommodated in the accommodating portions 24A, 24B. A male auxiliary connector 40C has a construction similar to the male auxiliary connector 40A and is accommodated in the accommodating portion 24C. Locks 61 and a restriction receiving portion 62 in this accommodating portion 24C are displaced more toward the back side with respect to the connecting direction CD as compared with the locks 27 and the restriction receiving portion 31 in the accommodating portion 24A. In other words, a partial locking position of the male auxiliary connector 40C is more backward than the male auxiliary connector 40A and is before a mount position of the male auxiliary connector 40B with respect to the connecting direction CD. Thus, the contact timing of the male auxiliary connector 40C with its mating connector 11D, 11E is different from the male auxiliary connector 40A, so that all male auxiliary connectors 40A–40C have different contact timings with their respective mating auxiliary connectors 11A–11E.

A female connector F2 has five accommodating portions 13A–13E arranged side by side in a female-side frame 63, and female auxiliary connectors 11A–11E are in the respective accommodating portions 13A–13E. The accommodating portions 13D, 13E and the female auxiliary connectors 11D, 11E therein are similar to the accommodating portions 13A, 13B and the female auxiliary connectors 11A, 11B accommodated therein. The connecting surfaces thereof are flush with each other when the female auxiliary connectors 11A–11E are mounted in the female-side frame 63.

When the connection of the female and male connectors F2, M2 is started, a pushing portion 16 of the accommodating portion 13A first resiliently deforms the resilient restricting piece 153, which then engages the restriction receiving portion 31 to restrict a displacement of the male auxiliary connector 40A. Tabs 43A project from the male auxiliary connector 40A and are inserted into terminal connecting portions of female terminal fittings (not shown) of the female auxiliary connectors 11A, 11B to start the connection of the male auxiliary connector 40A and the female auxiliary connectors 11A, 11B.

The pushing portion 16 of the accommodating portion 13D then deforms the resilient restricting piece 153 of the male auxiliary connector 40C, which engages the restriction receiving portion 62 to restrict a displacement of the male auxiliary connector 40C, thereby starting the connection of the male auxiliary connector 40C and the female auxiliary connectors 11D, 11E.

The female auxiliary connectors 11A, 11B reach a position where they abut the male auxiliary connector 40A as the connection of the female and male connectors F2, M2 proceeds. The resilient restricting piece 153 then is restored to its original shape and disengages from the restriction receiving portion 31. The male auxiliary connector 40A is displaced toward the back side with respect to the connecting direction CD as the connection proceeds further. The resilient restricting piece 153, restored to its original shape, disengages from the restriction receiving portion 62 when the female auxiliary connectors 11D, 11E reach a position where they abut against the male auxiliary connector 40C. The male auxiliary connector 40C is displaced toward the back side with respect to the connecting direction CD as the connection proceeds. Finally, the male auxiliary connector 40B and the female auxiliary connector 11C are connected, and the connection of the female and male connectors F2, M2 is completed when the upper connecting surfaces of the respective male auxiliary connectors 40A to 40C become substantially flush with each other.

If the male auxiliary connectors are arranged in the order of 40A, 40C, 40B from front in the male-side frame 60, the connectors F2, M2 may be inclined to each other and may not be properly connected with each other due to a connection resistance skewed toward one side during the connection of the female and male connectors F2, M2. However, in this embodiment, the male auxiliary connector 40B is between the male auxiliary connectors 40A, 40C mounted at positions before the final mount position with respect to the connecting direction CD. Thus, the connection resistance is unlikely to skew toward one side and a connecting operation can be performed smoothly.

The invention is not limited to the above described and illustrated embodiments. For example, the following embodiments also are embraced by the technical scope of the present invention as defined in the claims. Beside the following embodiments, various changes can be made without departing from the scope and spirit of the present invention as defined in the claims.

Contrary to the illustrated embodiments, the female connector may have the auxiliary connector housings movable along the connecting direction and held at the partial locking position.

In the first foregoing embodiment, the divided connector has two auxiliary connector housings that are connected with the mating side at different positions, and the connecting operation is performed at two stages. However, according to the present invention, three or more auxiliary connectors may be provided, and an operation of connecting these auxiliary connectors may be performed at three or more stages.

What is claimed is:

1. A divided connector, comprising:

a frame with at least first and second accommodating portions, at least one resilient lock formed at an inner surface of the first accommodating portion, at least first and second auxiliary connectors mounted respectively in the first and second accommodating portions, the first and second auxiliary connectors being each connectable with at least one mating auxiliary connector in a mating connector, wherein:

at least the first auxiliary connector defining a displaceable auxiliary connector held in the frame in a temporary mount position by the resilient lock in the first accommodating portion and being movable along a connecting direction to a final mount position upon deflection of the resilient lock away from the first auxiliary connector, the displaceable auxiliary connector coming into contact with the mating auxiliary connector while being in the temporary mount position such that mating forces exerted on the frame cause deflection of the resilient lock and permit relative movement of the frame and the first auxiliary connector to the final mount position of the first auxiliary connector without contact of the resilient lock by the mating connector, and the second auxiliary connector being connected subsequently with the mating auxiliary connector.

2. The divided connector of claim 1, wherein the resilient lock is a semi-locking mechanism for unlocking the first auxiliary connector by resiliently deforming the resilient lock when an external force of at least a specified amount is exerted on the displaceable auxiliary connector locked at the temporary mount position in the connecting direction.

3. The divided connector of claim 2, wherein the resilient lock is prevented from undergoing a deformation in an unlocking direction by an unlock preventing portion in the mating connector while the first auxiliary connector and the mating connector are being connected, thereby preventing displacement of the first auxiliary connector, whereas the resilient lock is freed from the unlock preventing portion when the first auxiliary connector and the mating connector are connected completely, thereby freeing the first auxiliary connector.

4. The divided connector of claim 1, further comprising a third auxiliary connector at a side of the second auxiliary connector opposite the first auxiliary connector, the third auxiliary connector defining a second displaceable auxiliary connector.

5. A divided connector comprising:

a frame with at least first and second accommodating portions, at least first and second auxiliary connectors mounted respectively in the first and second accommodating portions, the first and second auxiliary connectors being each connectable with at least one mating auxiliary connector in a mating connector, wherein:

at least the first auxiliary connector defining a displaceable auxiliary connector and being mounted in the frame for displacement along a connecting direction with the mating connector between a temporary mount position and a final mount position, the displaceable auxiliary connector coming into contact with the mating auxiliary connector while being in the temporary mount position, and the second auxiliary connector being connected subsequently with the mating auxiliary connector while the displaceable auxiliary connector is displaced toward the final mount position, a holding means provided between the displaceable auxiliary connector housing and the frame for holding the displaceable auxiliary connector housing at the temporary mount position when the mating connector is connected, the holding means comprising a resilient restricting piece formed at the displaceable auxiliary connector and resiliently deformable at an angle to the connecting direction, and a restriction receiving portion formed in the frame, wherein the resilient restricting piece is resiliently deformed by the mating connector to engage the restriction receiving portion while the displaceable auxiliary connector is being connected with the mating auxiliary connector, thereby restricting a displacement of the displaceable auxiliary connector, whereas the resilient restricting piece is restored towards its original shape and disengaged from the restriction receiving portion upon complete connection of the displaceable auxiliary connector with the mating auxiliary connector.

6. A divided connector, comprising:

a frame with first, second and third accommodating portions formed therein such that the second accommodating portion is between the first and third accommodating portions, the frame having a mating end for mating with a mating connector;

first, second and third auxiliary connectors mounted respectively in the first, second and third accommodating portions, the first, second and third auxiliary connectors being each connectable with at least one mating auxiliary connector in the mating connector, wherein:

the first and third auxiliary connectors being mounted in the frame for displacement along a connecting direction with the mating connector between a temporary mount position where the first and third auxiliary connectors are closer to the mating end and a final mount position where the first and third auxiliary connectors are further from the mating end and substantially aligned with the second auxiliary connector, such that the first and third auxiliary connectors connect with the mating auxiliary connector while in the temporary mount position, and the second auxiliary connector being connected subsequently with the mating auxiliary connector while the displaceable auxiliary connector is displaced toward the final mount position.

7. The divided connector of claim 6, further comprising holding means between the frame and the first and third auxiliary connector housings for holding the displaceable auxiliary connector housing at the temporary mount position when the mating connector is connected.

8. The divided connector of claim 7, further comprising means for releasing the holding means when the first and third auxiliary connectors and the mating connector are connected completely.

9. The divided connector of claim 8, wherein the holding means comprises at least one resilient lock formed at an inner surface of the accommodating portion and engageable with the displaceable auxiliary connector by resiliently deforming at an angle to the connecting direction.

10. The divided connector of claim 9, wherein the resilient lock is prevented from undergoing a deformation in an unlocking direction by an unlock preventing portion in the mating connector while the first and third auxiliary connectors and the mating connector are being connected, thereby preventing displacement of the first and third auxiliary connectors, whereas the resilient lock is freed from the unlock preventing portion when the first and third auxiliary connectors and the mating auxiliary connector are connected completely, thereby freeing the first and third auxiliary connector.

* * * * *